US007290747B2

(12) United States Patent
Appelman

(10) Patent No.: US 7,290,747 B2
(45) Date of Patent: Nov. 6, 2007

(54) DISPLAY CASE PROTECTION DEVICE

(75) Inventor: Ronald S. Appelman, 29230 E. Apache, Catoosa, OK (US) 74015

(73) Assignee: Ronald S. Appelman, Catoosa, OK (US)

( * ) Notice: Subject to any disclaimer, the term of this patent is extended or adjusted under 35 U.S.C. 154(b) by 2 days.

(21) Appl. No.: 11/223,526

(22) Filed: Sep. 9, 2005

(65) Prior Publication Data

US 2007/0057137 A1 Mar. 15, 2007

(51) Int. Cl.
*E04F 13/06* (2006.01)

(52) U.S. Cl. ..... 248/345.1; 16/404; 52/288.1; 49/462

(58) Field of Classification Search ..... 248/345.1; 16/404; 428/11; 49/460, 462; 404/9; 116/63 P; 52/288.1

See application file for complete search history.

(56) References Cited

U.S. PATENT DOCUMENTS 5,508,078 A * 4/1996 Stalnaker ..... 428/71
5,891,534 A * 4/1999 Sabin et al. ..... 428/11
6,260,237 B1 * 7/2001 McCue et al. ..... 16/404
6,945,730 B1 * 9/2005 Lobban ..... 404/9
2006/0230681 A1 * 10/2006 Appelman ..... 49/49

* cited by examiner

*Primary Examiner*—Anita M. King
(74) *Attorney, Agent, or Firm*—Henry L. Ehrlich; Winstead PC

(57) ABSTRACT

A display case protection assembly for protection of a portion of a display case from damage from impacts includes a guard member having a convex shaped first side, a concave shaped second side, a top end and a bottom end; a retaining sleeve is in communication with the assembly's concave shaped second side and is purposed for rotatably containing an offset positioning bar having an angularly displaced foot portion. The assembly may further include at least one receiving sleeve configured to receive the angularly displaced foot portion and the offset positioning bar may further include a retaining flange extending beyond the outermost periphery of the offset positioning bar when the bar has been contained within retaining sleeve.

6 Claims, 3 Drawing Sheets

DISPLAY CASE PROTECTION DEVICE

CROSS REFERENCE

This application does not claim priority from any prior application.

STATEMENT OF FEDERALLY SPONSORED RESEARCH/DEVELOPMENT

This application is not federally sponsored research/development.

REFERENCES TO SEQUENCE LISTING

This application is not referenced to any microfiche appendix.

BACKGROUND OF THE INVENTION

Facilities such as malls, airports, train stations, and even smaller establishments such as grocery stores, typically have fixtures, such as display shelves, booths, refrigerated cabinets and counters, that must be accessible, attractive and convenient to the consumer, yet also must be protected from damage from a constant onslaught of customers, not to mention employees, cleaning crews and maintenance personnel. The potential for repeated, costly damage to fixtures from people, some of whom may be relatively unskilled or inattentive, yet operating heavy equipment or shopping carts, is ever present.

A grocery store, for example, often has low, open refrigeration cabinets for display of perishable goods such as dairy products, meat and fish. Behind the lightweight sheet metal facades of these cabinets lies delicate internals—compressors, condensers, cooling coils, and associated control circuitry such as thermostats and temperature sensors—that are required to refrigerate the goods. The facade provides minimal protection, and there are many opportunities for damage. A careless shopper with a full shopping cart, or a stock boy with a heavily loaded pallet cart (which can weigh upwards of 1000 pounds), or cleaning person operating a self-propelled industrial floor cleaner, can, via one careless collision, do damage to the cabinet. Particularly vulnerable are the cooling coils, which are routed throughout the cabinet and which contain a volatile and expensive refrigerant. Even if the internals are not damaged, the appearance of the cabinet can, over time, suffer considerably. Fixtures are often designed, not as industrial fortresses, but as an aesthetically pleasing and convenient part of a total package for marketing goods. Yet protection is a must, if costly repairs are to be avoided. Similar considerations apply to less sophisticated fixtures, such as checkout counter, and wall corners. Constant bumping from a vacuum cleaner can leave dings, dents, and gouges that are unsightly, necessitating constant and tedious minor repairs.

Known in the art are protective rails and corner guards installed about the periphery of a fixture or structure. Rails typically comprise a base member incorporating an abrasion-resistant plastic strip that is available in many colors for matching the surrounding color scheme. Often, floor mounted base rails are mounted approximately 5" to 8" above a floor, and are removable. Rails are not limited to installation in floors, however, and can dispose about, or attached to, a structure so as to best protect the structure from damage. For example, a rail system can be attached to a wall or other structure. Rail systems are typically modular, and may have a limited number of lengths of straight sections and of curvatures of corner sections available. A particular rail system for protecting a structure or fixture is built-up from available modular rail sections and corners. One example of a known protection system is disclosed in U.S. Pat. No. 5,149,569, issued on Sep. 22, 1992 to David S. McCue, and herein incorporated by reference.

Corner guards present greater difficulties. Typically, a limited number of pre-molded corner guards are available as corners are the most frequently struck part of display case protection They often abrade and become unsightly from the constant collision and scraping.

One of the most frustrating conditions with respect to corner guards designed to protect refrigerated cabinets, counters and the like is the initial positioning and installation of the guard. Contemporary art guards rely upon holes previously drilled and positioned into a floor covering such as but not limited to concrete/tile. The predrilled holes must align perfectly with positioning bars permanently attached to the corner guard. Should the holes and positioning bars not be so aligned the guard is rendered virtually useless until such time as the holes are filled and then redrilled to accommodate the predetermined distancing consistent with the positioning bars connection/attachment to the corner guard. A further detriment to contemporary corner guards is the material from which they are typically constructed. Such material is usually a resilient rubberized material susceptible to dings, cuts, scratches, and other contributing factors, which contribute to a less than desirable aesthetic presentation.

Accordingly, it is an object of the present invention to provide a robust fixture protection system that withstands collisions with objects.

It is another object of the present invention to provide a corner for a fixture protection system that is less susceptible to abrasion and damage.

Yet a further object of the present invention is to provide a fixture protection system that lessens the likelihood of damage to protective members of the system or to an object that collides therewith.

A further object of the present invention is to disclose and claim a display case protection device, which is adaptable to positioning within misaligned predrilled accommodations.

Yet another object of the present invention is to disclose and claim a display protection assembly, which is adaptable to a multiplicity of applications and may be configured to accommodate a variable height/width positioning requirement.

An object of the present invention is to disclose and claim a display case protection device comprised of a material impervious to unintentional or inadvertent bumping and scraping

BRIEF SUMMARY OF THE INVENTION

According to one aspect of the invention a display case protection assembly for protection of a portion of a display case from damage from impacts is disclosed and comprises a guard member having a convex shaped first side (1), a concave shaped second side (2), a top end (4) and a bottom end (5); a retaining sleeve (8) is in communication with the assembly's concave shaped second side (2) and purposed for rotatably (20) containing an offset positioning bar (12) having an angularly displaced (16) foot portion (15). The assembly may further comprise at least one receiving sleeve (18) to receive the angularly displaced foot portion (15) of the offset positioning bar (12). The offset positioning bar (12) may further comprise a retaining flange (13) extending beyond the outermost periphery of the offset positioning bar (12) when the bar (12) has been contained within retaining sleeve (8). The assembly may further comprise a first impact area lip (3) in communication with top end (4).

DETAILED DESCRIPTION OF THE INVENTION

Figure 1:
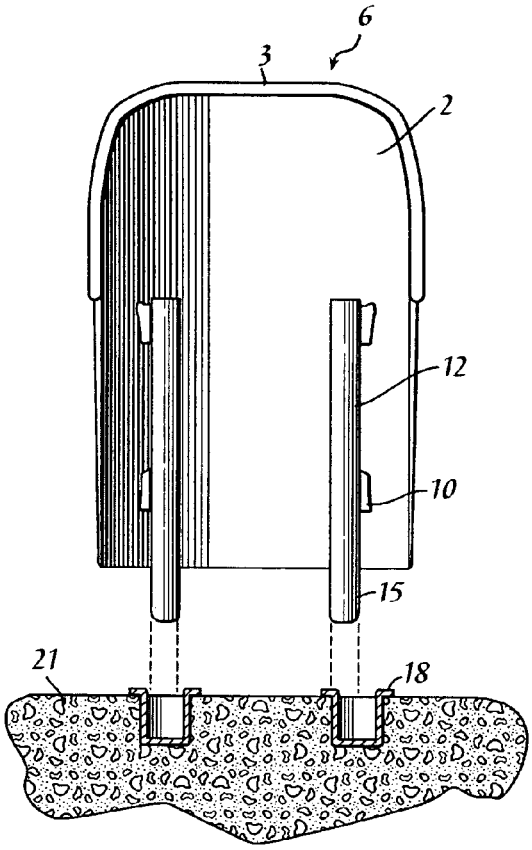
Fig. 1 (PRIOR ART)
FIG. 1 is an illustration of a prior art display cabinet bumper with fixed, non-compensating positioning bars.
Figure 2:
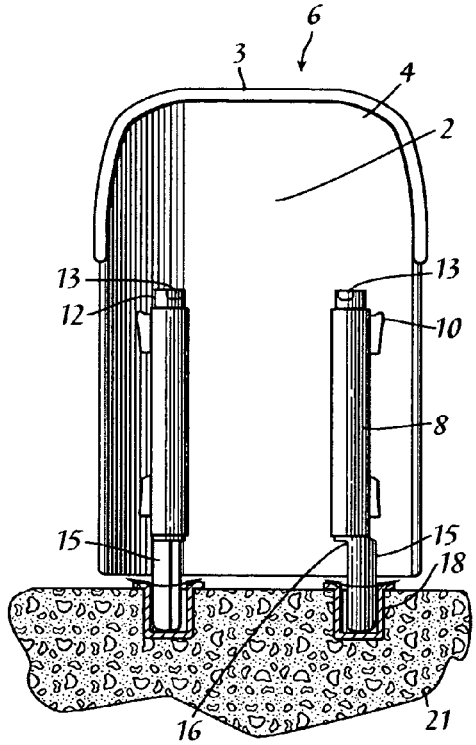
FIG. 2 is an illustration of an embodiment of the present invention with offset rotatable compensating positioning bars, inserted within a positioning sleeve.
Figure 3:
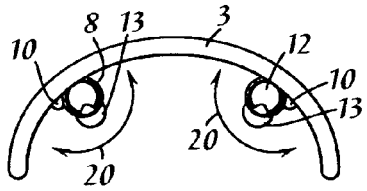
FIG. 3 is a plan view illustration of the embodiment of FIG. 2, further illustrating the arc angularly displaced foot portions of the inventions rotatable positioning bars.
Figure 4:
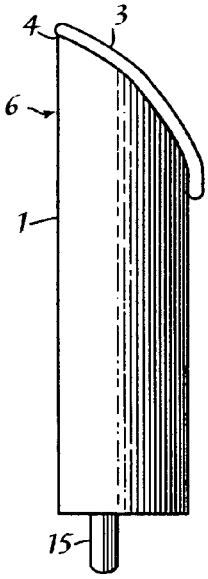
FIG. 4 is a left side angularly view of the embodiment of FIG. 2.
Figure 5:
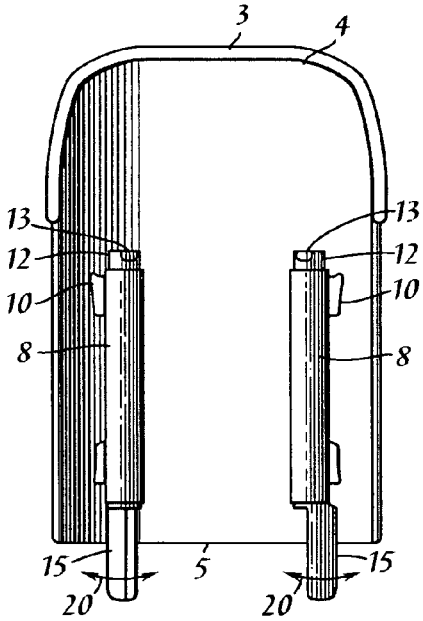
FIG. 5 is a rear elevational view of the embodiment of FIG. 2, further illustrating the compensating arc of angularly displaced foot portions of the inventions rotatable positioning bars.
Figure 6:
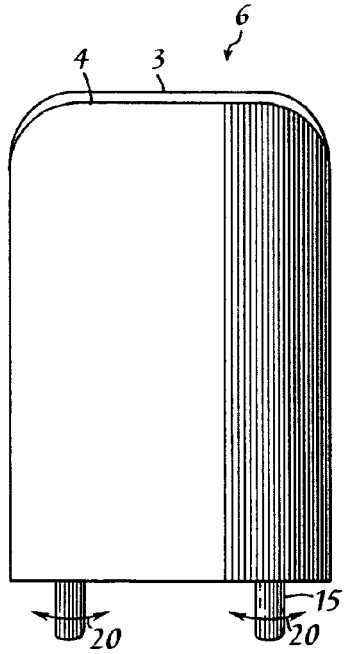
FIG. 6 is a front elevational view of the embodiment of FIG. 2, further illustrating compensating arc of angularly displaced foot portions of the inventions rotatable positioning bars.
Figure 7:
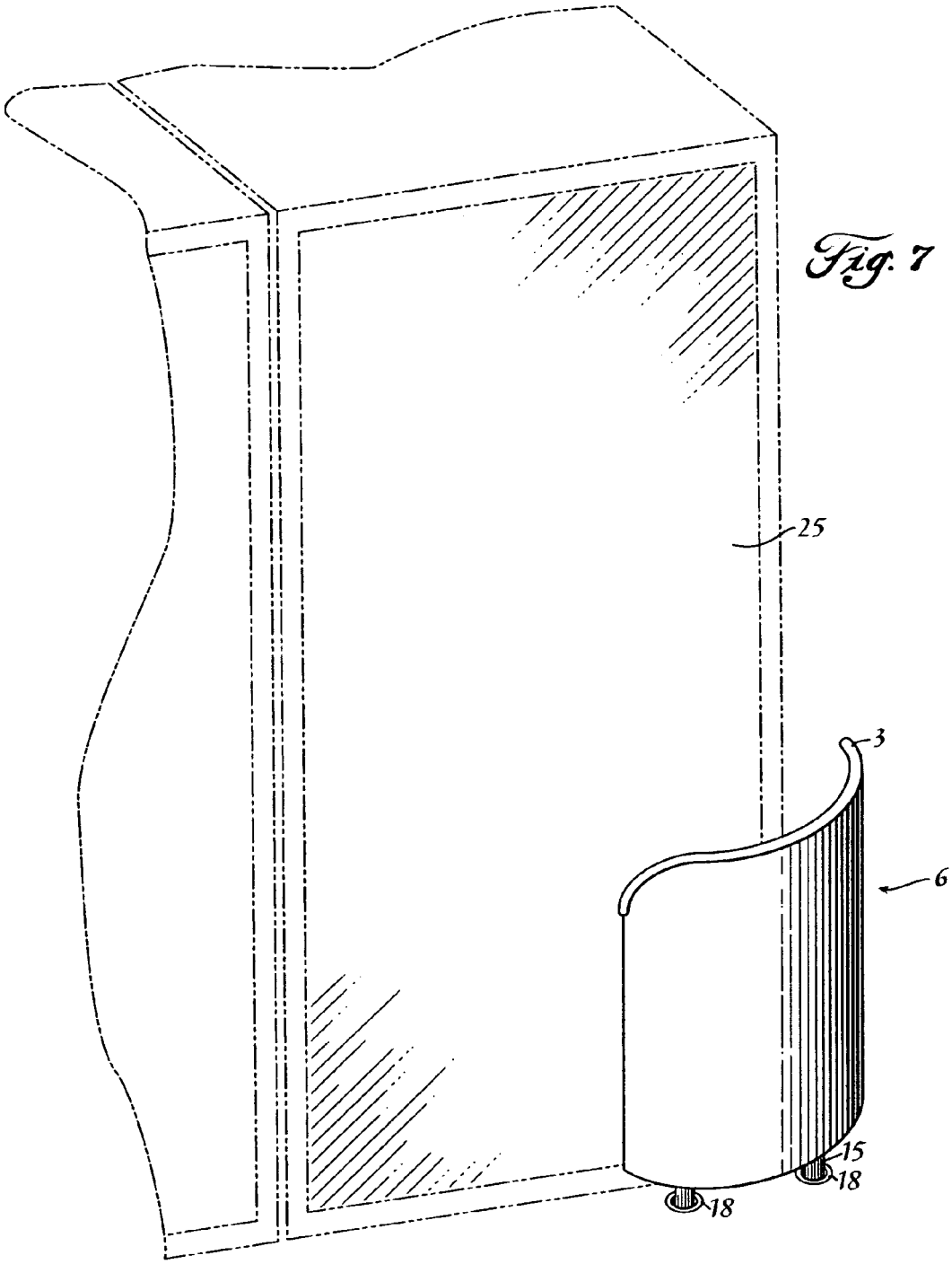
FIG. 7 is an illustration of an embodiment of the present invention positioned and secured to protect the corner of a display cabinet.

The present invention will now be described with reference to the drawings wherein like reference numerals are used to refer to like elements throughout.

FIG. 1 is a prior art illustration of a display cabinet bumper with fixed noncompensating positioning bars (12). As used throughout this disclosure the terms display cabinet bumper, bumper, display case protection device, and display case protection assembly are all used interchangeably and synonymously. Turning now to FIG. 1.

In FIG. 1 a receiving sleeve (18) is shown inserted into a predrilled hole in ground covering substance such as concrete, tile or wood (21). The positioning bars (12) of the prior art display cabinet bumper (6) are shown attached to the concave shaped second side (2) of the guard (6). Such attachment is typically, though not exclusively, permanent in nature and is indicated in the prior art illustration as a weld (10). The previously drilled holes in which receiving sleeves 18 have been inserted must be perfectly aligned with the permanently attached positioning bars (12) to allow the positioning bars aligning insertion into the sleeves (18). As indicated in FIG. 1 prior art illustration, a misalignment of the receiving sleeves/predrilled holes within ground structure (21) prohibits the insertion of positioning bars (12).

FIGS. 2-7 disclose and teach the present invention in which positioning bars (12) further comprise and offset foot portions (15). Positioning bars (12) as illustrated in FIGS. 2-7 are contained within a retaining sleeve (8) allowing for rotation (20) of bar (12) and foot portion (15) thus eliminating the deficiency of the prior art fixed position positioning bars. As indicated in the present invention the offset foot capability (15) of positioning bar (12) allows for a compensating adjustment (20) co align the foot portions within a misaligned previously drilled bore containing or not containing a receiving sleeve (18). In FIGS. 2-7, it is further shown where the display case protection assembly for protection of a portion of display case (25) from damage is shown comprising, a guard member having a convex shaped first side (1), a concave shaped second side (2), a first impact area lip (3), a top end (4) and a bottom end (5), a retaining sleeve (8) in communication with the guard member's concave shaped second side (2), and, an offset positioning bar (12) rotatably contained (20) within the retaining sleeve (8) and having an angularly displaced (16) foot portion (15). The guard member may be of a metal composition.

As will be readily appreciated by those skilled in the art the guard member protection assembly may be variably dimensioned to fit the variety of height or width requirements. In extensive testing it has been shown that the guard number (6) may vary in height from 12" to 33" and its width may vary from a width of 5½" to 13" as measured across the invention's widest convex portion. When varying the dimensions the guard member of the present invention those skilled in the art will rarely appreciate a compensating adjustment must be made with respect to the placement height and width of retaining sleeve (8) attachment weld sections (10) depth and width of offset foot portions (15) and depth of previously drilled bores to accommodate receiving sleeve (18). In extensive experimentation, the following dimensions have yielded an effectively practiced configuration of invention component members.

- The typical application of the invention's protection assembly is to corner case, fixture or wall protection requirements.
- The typical (average) protection assembly is 18" to 30" in height.
- The typical (average) offset foot portion varies between 2 and 3/1;2" as measured vertically.
- The typical arc for each foot portion will allow for a radial displacement varying between ¼" and ½".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired.

It is therefore, contemplated that the claims will cover any such modifications or embodiments that fall within the true scope of the invention.

What is claimed is:

1. A display case protection assembly for protection of a portion of a display case from damage from impacts thereto, comprising:

a guard member having a convex shaped first side, a concave shaped second side, a top end and a bottom end, a retaining sleeve in communication with the guard member's concave shaped second side; and, an offset positioning bar rotatably contained within the retaining sleeve and having an angularly displaced foot portion.

2. The assembly of claim 1 further comprising at least one receiving sleeve configured to receive the offset positioning bar.

3. The assembly of claim 1 further comprising a first impact area lip in communication with top end.

4. The assembly of claim 1 wherein the offset positioning bar further comprises a retaining flange extending beyond the outermost periphery of the offset positioning bar when the bar has been contained within retaining sleeve.

5. The assembly of claim 2 wherein the receiving sleeve permits each angularly displaced foot portion of the offset positioning bar to swing in an arc varying between ¼" and ½".

6. The assembly of claim 5 wherein the guard member is of a metal composition.

* * * * *